United States Patent [19]

Yeaman, Sr.

[11] Patent Number: 4,693,412

[45] Date of Patent: Sep. 15, 1987

[54] SLEEVE PACKAGE HAVING LOCKING TABS FOR HOLDING MULTIPLE ACEPTIC CARTONS

[75] Inventor: William E. Yeaman, Sr., Park Ridge, Ill.

[73] Assignee: Yeaman Packaging Group, Inc., Wheeling, Ill.

[21] Appl. No.: 773,793

[22] Filed: Sep. 9, 1985

[51] Int. Cl.[4] ..... B65D 75/06

[52] U.S. Cl. ..... 229/40; 206/431; 206/434

[58] Field of Search ..... 229/40; 206/427, 429, 206/431, 434; 220/400, 449, 468

[56] References Cited

U.S. PATENT DOCUMENTS

| | | | |
|---|---|---|---|
| 2,260,424 | 10/1941 | Waters | 229/27 |
| 2,571,833 | 10/1951 | Chidsey, Jr. | 206/434 |
| 2,675,264 | 4/1954 | Vanderlugt, Jr. | 206/431 |
| 2,684,759 | 7/1954 | Freeman | 206/434 |
| 2,911,096 | 11/1959 | Andre | 206/434 |
| 2,975,891 | 3/1961 | Stone | 206/434 |
| 2,986,272 | 5/1961 | Kruse | 206/431 |
| 3,223,233 | 12/1965 | Becker et al. | 229/40 |
| 3,249,284 | 5/1966 | Wood | 229/40 |
| 3,395,791 | 8/1968 | Graser | 229/40 |
| 3,411,264 | 11/1968 | Farquhar | 229/40 |
| 3,589,593 | 6/1971 | Weiss | 229/40 |
| 3,635,452 | 1/1972 | Helms | 229/40 |
| 3,670,879 | 6/1972 | Williard et al. | 206/431 |
| 3,680,691 | 8/1972 | Lock | 229/40 |
| 3,698,624 | 10/1972 | Stark | 229/23 R |
| 3,833,116 | 9/1974 | Howe | 206/431 |
| 3,892,348 | 7/1975 | Rohner | 229/23 R |
| 3,900,103 | 8/1975 | Day | 206/431 |
| 3,986,658 | 10/1976 | Arneson | 229/40 |
| 4,415,082 | 11/1983 | Martin | 206/431 |
| 4,441,611 | 4/1984 | Sommariva | 206/431 |
| 4,458,836 | 7/1984 | Wood | 229/40 |

*Primary Examiner*—Stephen Marcus
*Assistant Examiner*—Gary E. Elkins
*Attorney, Agent, or Firm*—Charles F. Lind

[57] ABSTRACT

The disclosed sleeve package is suited for economically holding a multi-pack arrangement of aceptic paperboard cartons. The sleeve blank has main side, top and bottom panels successively hinged to one another, to be wrapped around the arranged cartons, with inner and outer lap panels being secured together to provide an open-ended sleeve. Tabs are formed off the inner lap panel, being hinged thereto by a fold line that extends in a direction between the opposite side edges of the blank. Several embodiments are disclosed, one for holding the cartons with each tab underlying or cooperating with an end closure seam flap; and the other for holding cartons with each tab edge abutting the end closure seam flap or any other appropriate edge thereon. Also, the tab in one embodiment is folded 180 degrees to lie between the inner lap panel and the carton end closure; while in another embodiment, the tab remains almost coplanar with the inner lap panel and lies between the outer lap panel and the carton end closure. The disclosed sleeve package provides large uninterrupted exposed panel areas for advertising display copy, and uses little excess board beyond that needed merely to wrap around the arranged cartons.

16 Claims, 12 Drawing Figures

48
50
52
42
54
56
58
60
62
46
49
51
53
55
57
62
60
44
42
40

24
20
22
26
28
12
32

60
62
58
57
24
22
34
24
26
12
60
16
12
22
32
14
12
50
49
48
51
14
18
10

SLEEVE PACKAGE HAVING LOCKING TABS FOR HOLDING MULTIPLE ACEPTIC CARTONS

CROSS-REFERENCE TO RELATED APPLICATION

This application is related to Applicant's copending application, entitled SLEEVE PACKAGE HAVING REVERSE TUCKED TABS FOR HOLDING MULTIPLE ACEPTIC CARTONS, that is being filed concurrently herewith.

FIELD OF THE INVENTION

This invention relates to a paperboard sleeve package for holding a plurality of cartons, and particularily, for holding aceptic cartons grouped together in a multi-pack arrangement.

BACKGROUND OF THE INVENTION

Aseptic cartons are commonly being used for marketing fruit juices, milk, or other liquid based food products, in quantities suited for individual servings, such as perhaps a quarter of a liter. Such cartons are formed of a paperboard material, laminated or coated with a plastic film, to be liquid-tight. Each carton is shaped somewhat as a solid block, having generally parallel opposed pairs of side and end walls, each perpendicular to the others. Like cartons are thus suited to be grouped together tightly against one another, for marketing as a multi-pack in a paperboard container or package.

One such container or package is of a generally economical wrap around style, represented by a blank having adjacent side, top and bottom main panels hinged sucessively to one another, that are folded around the grouped cartons, and having lapped panels that are then secured together. The package is thus somewhat open-ended. The cartons are held in place within the package by small gusset panels, hinged off of the main panels of the package, that span across and partically close the open ends of the package, and that overlie part of the end cartons in the package.

The cost of the container or package is closely related to the size of the blank, and of course, the larger the blank, the more expensive the package. The blank that forms this type of open-ended but gusseted package is quite compact and small, and thus economical, as the package does not completely enclose the cartons, but leaves the end cartons at least partically exposed.

Nesting of adjacent package blanks is also important in reducing waste in the overall board requirement of the package. As only limited nesting of blanks of adjacent gusseted packages is possible, because of the small gusset panels, the effective overall blank width turns out to be virtually equal to the width of the finished container or package, plus the width of the gusset panels hinged off of the opposite sides of the main panels.

This type of package moreover requires equipment for tucking the gusset panels in place, as the blank in wrapped around the arranged cartons.

Nonetheless, the package offers stability, strength, and large side and top panels for advertising copy, and is quite popular for marketing these aceptic cartons arranged as a multi-pack.

OBJECTS OF THE INVENTION

A basic object of the present invention is to provide an improved multi-pack container or package, particularly for holding liquid-tight paperboard aceptic cartons for juices, liquid base food products, or the like, that can be more economical than the commonly used gusseted package.

The inventive blank can be smaller and consequently more economical, by perhaps 10–25%, compared to the competitive gusseted package.

Another basic object of this invention is to provide a sleeve package that can be easily formed, without gusset tucking equipment needed for the competitive gusseted packages.

A detailed object of the invention is to provide a sleeve type wrap-around package that is open-ended, to minimize board usage of the paperboard blank used for forming the sleeve, while yet having locking tab means for securely holding the cartons in place within the sleeve package.

Another detailed object of this invention is to provide tab means at the end of the blank used to form the sleeve type wrap-around package, so as to not add to the width of the blank, the tab means further being adapted when the blank is wrapped around the cartons, to cooperate with the cartons for holding them in the open-ended sleeve.

Another detailed object of this invention is to provide tab means in the blank that cooperate with the end closure of the endmost cartons in the sleeve package, by underlying a flap defined by a folded over seam in the end closure, and/or by abutting an edge defined in the end closure, operable to hold the cartons in the open-ended sleeve.

SUMMARY OF THE INVENTION

To achieve these and other objects, the present invention may provide a sleeve package intended for holding a plurality of aceptic cartons, the package comprising a paperboard sleeve that encircles the cartons but yet is open-ended, and further having tabs, formed off of an inner panel, that may be manipulated to fit under or otherwise cooperate with the carton end closure, operable to hold the cartons in place within the oped-ended sleeve package.

A feature of this invention provides that a paperboard blank may have inner and outer lap panels that are adapted to be glued or otherwise secured together to define the open-ended sleeve package, and further that the tabs may be formed at end of the blank off the inner lap panel, the tabs being manipulated when the blank is folded around the cartons to fit under or otherwise cooperate with the carton end closure and/or end closure flap or seam so as to hold the cartons in place within the oped-ended sleeve package.

Another feature of this invention provides that each end carton in the open-ended sleeve has an end closure that defines an edge and/or a flap open transverse to the open ends of the sleeve package, and that the locking tabs project in the direction transverse to the opposite open ends of the sleeve package, to interfit with the edge and/or flap for holding the cartons in place in the open-ended sleeve package.

In this invention, the tabs may be formed or hinged off an inner lap panel; and in one embodiment, the tabs may be folded 180 degrees relative to the lap lanel about a fold line extended transverse to the opposite open ends of the sleeve, and in another embodiment, may be almost coplanar with the lap panel; and the tabs may generally lie between the carton end closure and the inner and/or outer lap panel.

BRIEF DISCRIPTION OF THE DRAWINGS

Further objects, advantages and features of the present invention will appear from the following disclosure and description, including as a part thereof the accompanying drawings, in which.

Figure 3:
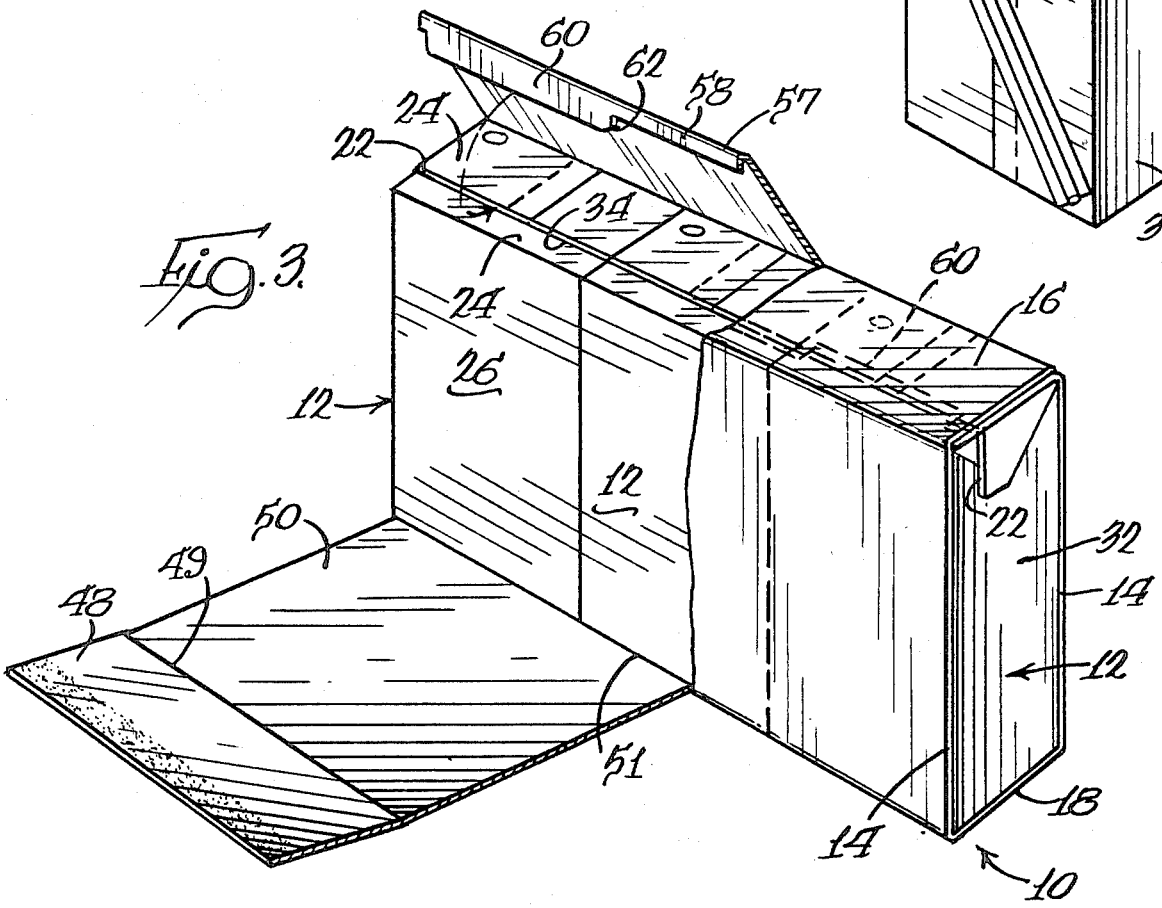
FIG. 3 is a perspective view of a row of three aceptic cartons and the blank of FIG. 1, wrapped around the cartons, to form the first embodiment of the sleeve packages to be disclosed herein.
Figure 4:
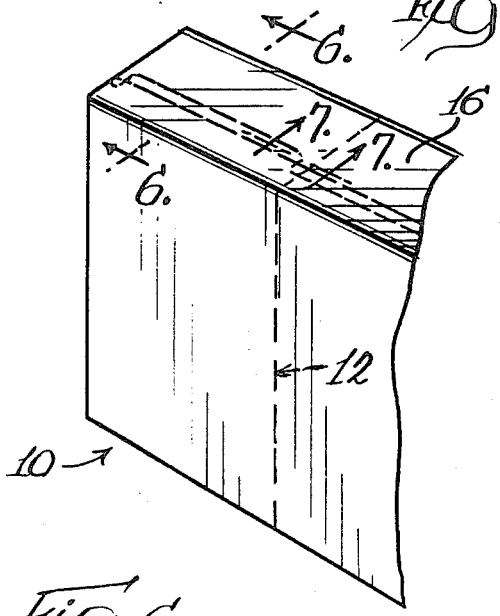
FIG. 4 is a perspective view of part of the sleeve package illustrated in FIG. 3.
Figure 5:
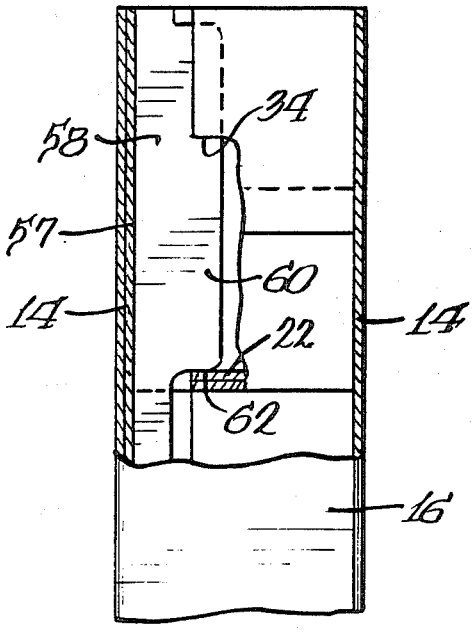
FIG. 5 is a plan-type view, partly in section, of part of the sleeve package illustrated in FIG. 4.
Figure 6:
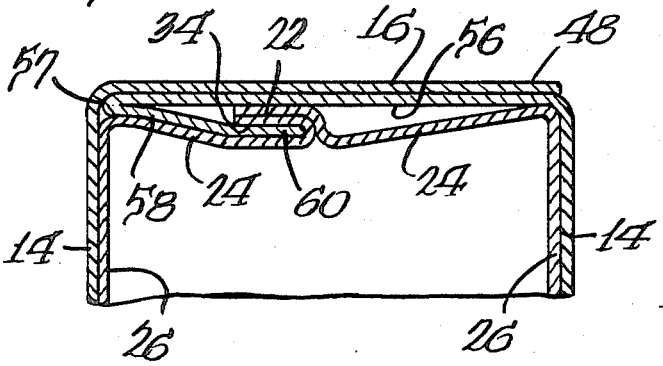
Figure 7:
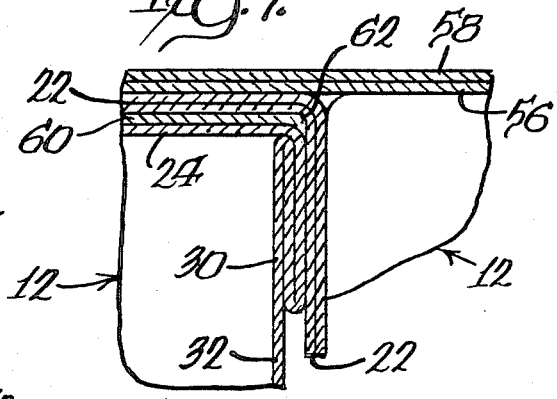
Figure 8:
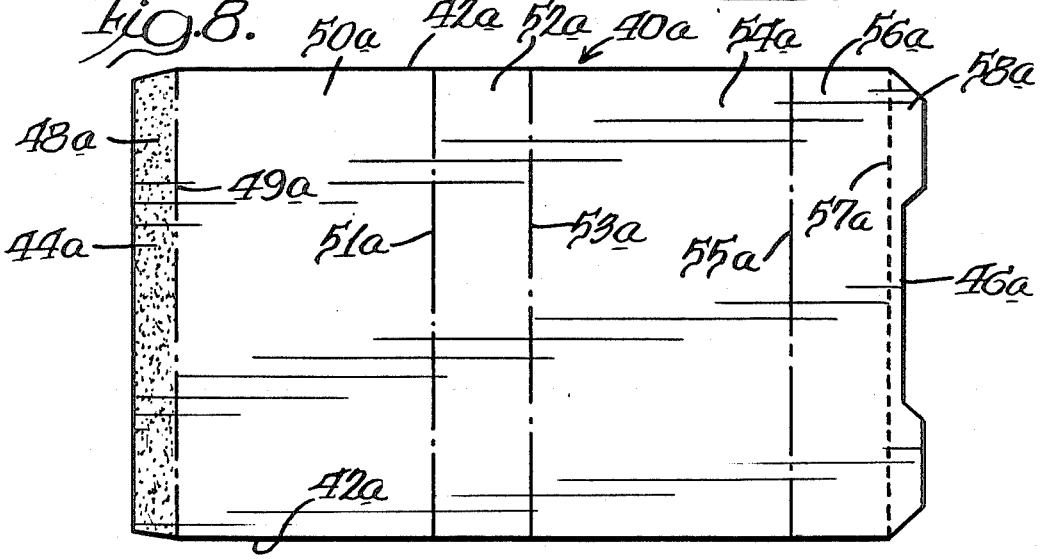
Figure 9:
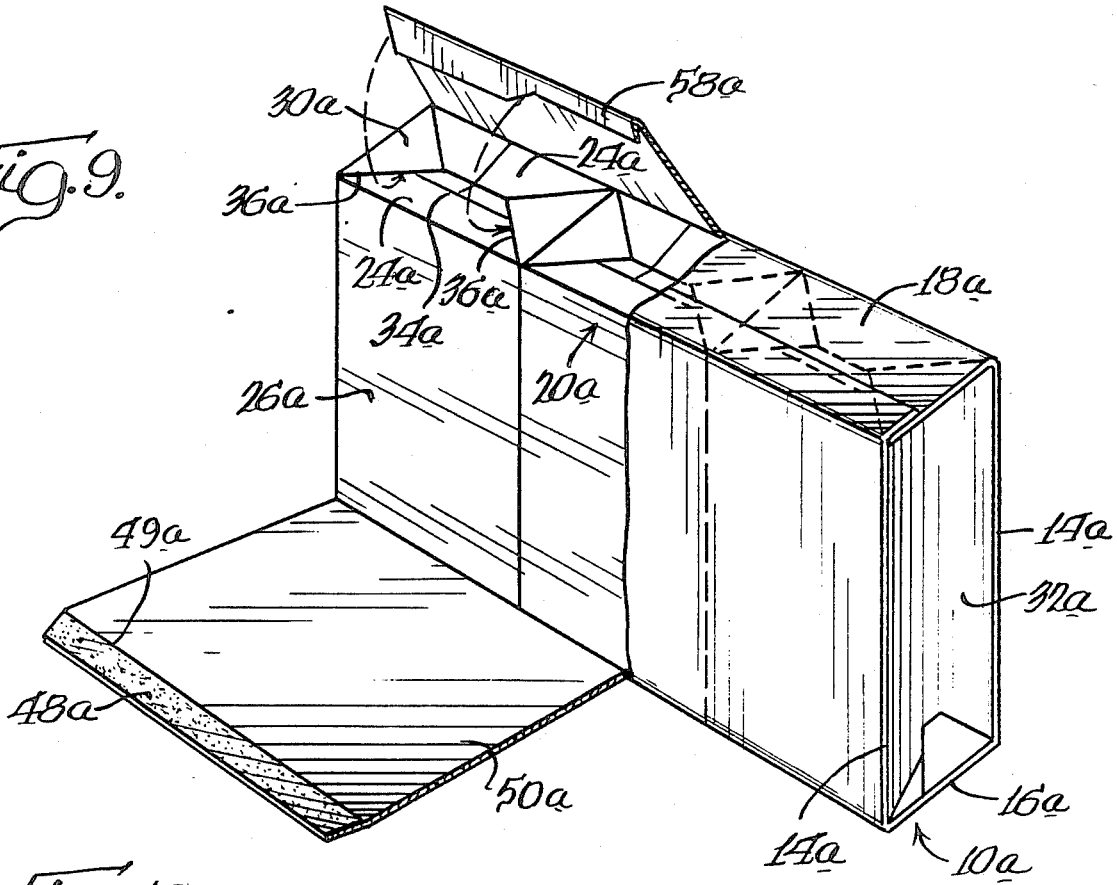
Figure 10:
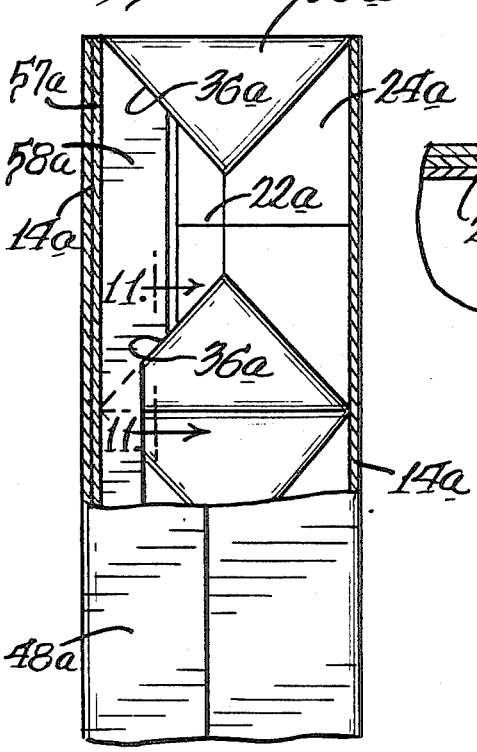
Figure 11:
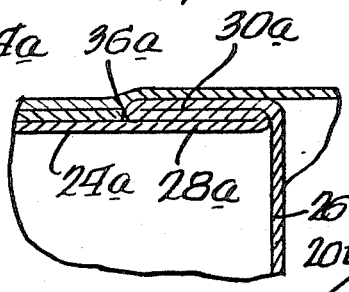
Figure 12:
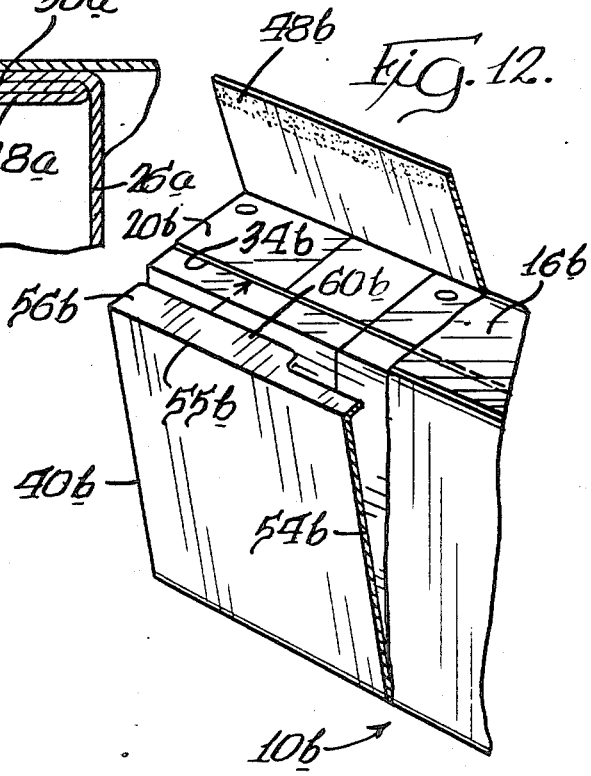

FIGS. 6 and 7 are sectional views, as seen respectively from lines 6—6 and 7—7 in FIG. 4, showing the cooperation of the locking tab and end closure of an endmost carton carried in the sleeve package;

FIG. 8 is a plan view of a blank used to form a second embodiment of the sleeve package disclosed herein in FIG. 9;

FIG. 9 is a perspective view, similar to FIG. 3, except illustrating, in an inverted orientation, a second embodiment of sleeve package, formed with the blank of FIG. 8;

FIG. 10 is a plan-type view, partly in section, of the sleeve package illustrated in FIG. 9, and of the end of the carton carried therein;

FIG. 11 is a sectional view, as seen from line 11—11 in FIG. 10, again showing the cooperation of the locking tab and end closure of the carton carried in the sleeve package; and FIG. 12 is a perspective view, similar to FIGS. 3 and 9, except illustrating yet a third embodiment of sleeve package to be disclosed herein.

DESCRIPTION OF PREFERRED EMBODIMENTS OF THE INVENTION

The sleeve package 10 (FIG. 3), and 10*a* (FIG. 9), and 10b (FIG. 12) to be disclosed herein, each is suited to hold a plurality of cartons 12 butted against one another across the short sides of the cartons, and arranged in a single row. Where appropriate, the sleeve packages 10*a* and 10*b* will be identified by the same reference numerals used for the sleeve package 10, except with the added suffix "a" or "b". Each sleeve package 10 (or 10*a*, or 10*b*) has opposed side walls 14 (or 14*a*, or 14*b*) and opposed top and bottom walls 16 (or 16*a*, or 16*b*) and 18 (or 18*a*, or 18*b*), respectively, and otherwise has opposite open ends to expose the endmost cartons 12 in the package.

Figure 2:
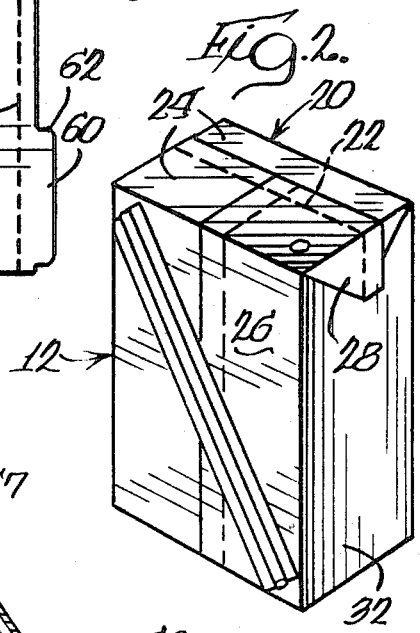
FIG. 2 is a perspective view of an aceptic carton of the type to be carried in the sleeve packages to be disclosed herein.

Each carton 12 (FIG. 2) is formed of a paperboard material, laminated or coated with a plastic film, to be liquid-tight; and is shaped somewhat as a solid block. Thus, each carton has generally parallel opposed pairs of side and end walls, mutally perpendicular to one another. The carton 12 is initially fabricated as an open-ended tubular element, generally rectangular in cross-section, and its opposite ends are desi9ned to be closed and sealed by closures formed by folded and seamed sections of the tubular element itself. Each disclosed sleeve packages 10 (or 10*a*, or 10*b*) has tabs that cooperate with the end closures of the endmost cartons in the row to hold the cartons in place within the open-ended sleeve package.

The carton end closures, 20 (see FIGS. 2, 3, 5, 6 and 7) and 20*a* (see FIGS. 9–11) may be of two general types. Closure 20 has a seam 22 that is made between main closure panels 24 hinged off of long side walls 26 of the carton, and between small triangular gusset panels 28 hinged off of end edges of the major closure panels 24 and minor triangular panels (30*a*, see FIGS. 9 and 10) hinged off of short side walls 32 of the carton. When the seam 22 is complete, the triangular gusset and minor panels 28 and 30 respectively project transverse to and outwardly beyond the short side walls 32 of the carton; and the seam 22 then may be disposed to lie flush against, but not be bonded to, the underlying main closure panels 24. The triangular gusset and minor panels 28 and 30 may then be folded 90 degrees away from the main closure panels 24 to lie against the short side walls 32 of the carton; and generally, the triangular panels 30 are bonded then in place against the corresponding side wall 32.

The seam 22, when disposed against the underlying main closure panels 24, defines a flap 34 that extends across the end closure of the carton, between the transverse edges closely adjacent the short side walls 32 defined where the seam and triangular panels 28 and 30 are folded to overlie these side walls.

The other form of carton end closure 20*a* (see FIGS. 9, 10 and 11) is similar to that just described, except that when the seam 22*a* is complete and disposed against the underlying main closure panels 24*a*, the triangular gusset and minor panels 28*a* and 30*a* respectively projecting transverse to and outwardly beyond the short side walls 32*a* of the carton are then back-folded 180 degrees to lie against the underlying seam 22*a* and main closure panels 24*a* of the carton. Generally, the inner of the triangular panels 28*a* is bonded then in place against the corresponding main closure panels 24*a*. This defines two edges 36*a*, each at the hinge line between the triangular panels 28*a* and 30*a*, that overlie the main closure panels 24*a* and extend traverse to the main side walls 26*a* of the carton and converge in the direction away from the wall.

Figure 1:
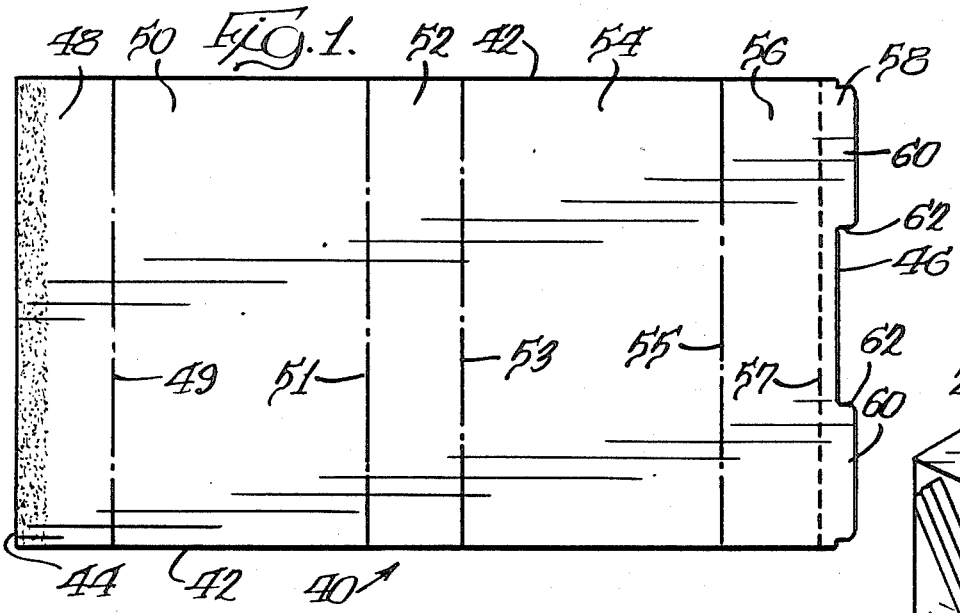
FIG. 1 is a plan view of a blank used to form a first embodiment of the sleeve package to be disclosed in FIGS. 3–7.

The sleeve package 10 is formed of a blank 40 (see FIG. 1) of paperboard, and is folded to encircle the cartons 12. The blank 40 may have substantially parallel side edges 42 and opposite end edges 44 and 46, may be elongated in the direction of the side edges 42 that define the end edges of the sleeve package as it is formed around the cartons, and may be substantially rectangular in shape. The blank 40 further may have substantially parallel fold or hinge lines 49, 51, 53, 55 and 57 to define sucessively hinged panels 48, 50, 52, 54, 56, and 58.

In the sleeve package 10, panels 50 and 54 correspond to the side walls 14 of the sleeve package, and panel 52 to the bottom wall 18; while panel 56 serves as the inner lap panel, panel 58 serves as the tab panel, and panel 48 serves as the outer lap panel, these panels together form the top wall 16. The top wall 16 overlies the end closures 20 of the cartons 12.

Tabs 60 for locking the cartons 12 in place within the open-ended sleeve package 10 are formed off of the inner lap panel 56, on tab panel 58. The tabs 60 are unitary with the panels 58, and project in the direction away from the adjacent hinging panel 56. Two tabs 60 are illustrated, one for each end carton in the row.

The tabs 60 are designed to be manipulated to fit under or otherwise cooperate with the flap 34 defined by the carton end closure seam 22. The side edge 62 of the tab 60, adjacent the inner end of the sleeve, thereby interfits with the carton end closure to hold the carton in place within and prevent the same from slipping out the open-ended sleeve package.

To form the sleeve package 10, the cartons 12 are first grouped on the bottom package panel 52, the side wall blank panels 50 and 54 of the package are folded against the sides 26 of the cartons, the inner panel 56 is brought over the end closures 20 of the cartons, and the tab panel 58 is folded almost a full 180 degrees relative to the plane of the adjacent hinging panel 56, to allow the tabs 60 to be manipulated into proper cooperation under the seam flap 34 of the end closure 20 of each endmost carton. The tab edge 62 is then also against the under edge of the closure seam 22 in the region of the folded-over triangular panels 28 and 30. The outer end panel 48 is brought into lapping relation with the inner lap panel 56, and the panels are bonded or otherwise secured together, as by glue strips laid between the inner and outer lap panels. The cartons are snugged tightly together as the sleeve is being formed around the arranged cartons, and while the adhesive is setting, to provide a solid package.

The tabs 60, being formed on tab panel 58 as part of the end edge 46 of the 40, do not add to the width of the blank, across the side edges 42. The tabs 60, when fitted under the carton end closure seam or flap, serve to hold the cartons in place within the open-ended sleeve package. The tab panel 58, when folded 180 degrees from the inner panel 56, lies between the inner panel 56 and the carton end closure.

The sleeve package 10*a* (see FIGS. 8–11) is formed of paperboard blank 40*a* having substantially parallel side edges 42*a*, opposite end edges 44*a* and 46*a*, and substantially parallel hinge lines 49*a*, 51*a*, 53*a*, 55*a*, and 57*a* that define sucessively hinged panels 48*a*, 50*a* 52*a*, 54*a*, 56*a*, and 58*a*. In the sleeve package 10*a*, unever carton end closure 20*a* is formed on the bottom wall of the carton, so that panels 50*a* and 54*a* correspond to the side walls 14*a* of the sleeve package, and panel 52*a* to the top wall 16*a*; while panel 56*a* serves as the inner lap panel, panel 58*a* serves as the tab panel, and panel 48*a* serves as the outer lap panel, and these lapped panels together form the bottom wall 18*a* and overlie the end closure 20*a*.

To form the sleeve package 10*a*, the cartons 12 are first grouped, unside-down, on the top panel 52*a*, the side panels 50*a* and 54*a* are folded against the sides 26*a* of the cartons, inner panel 56*a* is brought over the bottoms of the cartons, and tab panel 58*a* is folded almost a full 180 degrees relative to the adjacent hinging panel 56*a*, to manipulate the tab locking edge 62*a* against the edge 36*a*, of the triangular panels 28*a* and 30*a*. Because of this edge-to-edge contact, the tab 60*a* need not underlie the flap 34*a* of the end closure 20*a*. The outer lap panel 48*a* is then brought into lapping relation with the inner lap panel 56*a*, and the panels are bonded or otherwise secured together.

In sleeve package 10*b*, panel 54*b* corresponds to one of the the side walls 14*b* of the sleeve package, and panel 56*b* serves as a combined inner lap-tab panel that with the outer lap panel 48*b*, form the top wall 16*b*. The combined inner lap-tab panel 56*b* fits under the flap 34*b* and lies between the outer panel 48*b* and the end closure 20*b* of the carton, and tab 60*b* with the locking edge 62*b* is formed on this panel and remains generally coplanar therewith.

In the illustrated sleeve packages 10 (and 10*b*), outer lap panel 48 (or 48*b*) may be sufficiently large to overlie the entire inner panel. This may allow for good graphics, which particularly might be appreciated for an exposed top wall 16 (or 16*b*) of the sleeve package.

It may thus be appreciated that the disclosed sleeve packages 10 (or 10*a*, or 10*b*) are more economical than any gusseted package, by perhaps 10–25%. This is possible as the opposite side edges 42 (or 42*a*, or 42*b*) of the blank 40 (or 40*a*, or 40*b*) need extend only to the end of the package, or end of the endmost carton 12 carried therein, and no locking gusset panels are required off these edges to add to the blank width. In fact, the opposite side edges 42 (or 42*a*, or 42*b*) of the blank 40 (or 40*a*, or 40*b*) can even be shy or shortened compared to the end edge of the endmost carton to be carried in the sleeve package, and the carton may then merely project a little beyond the end edge of the sleeve package. The added board needed to define the lapping inner and tab panels is only on the short edge of the blank, to add little to the overall board requirement. Moreover, as the blank shape may be close to rectanglar in plan, very good nesting of adjacent blanks may be possible to provide for exceptional board economy.

The sleeve package 10 (or 10*a*, or 10*b*) is illustrated as holding three cartons 12, arranged in a single row, with the short sides 32 of the cartons butting and facing the open ends of the sleeve. However, the sleeve package may be used for different carton arrangements and/or numbers. The sleeve package 10*a* differs from package 10, as the locking tabs 60*a* cooperate with a different type of carton end closure 22a than end closure 22; while the sleeve package 10*b* differs from packages 10 and 10*a* by the combined and planar inner lap-tab panel, versus the inner lap panel 56 (or 56*a*) and the folded over tab panel 58 (or 58*a*). However, only minor modifications to the overall shape of the sleeve blank, and/or shape of the tabs, and/or the length of the tab panel or inner lap panel, are required to use the sleeve package for cartons having end closure means of different shape and/or size.

Although the aseptic cartons 12 are now being used for marketing fruit juices, milk, or other liquids in quantities suited for individual servings, such as perhaps a quarter of a liter; such usage does not limit either the size, or product, which may potentially be used. The invention is therefore intended to be limited only by the scope of the claims hereinafter following.

What is claimed is:

1. A sleeve package for holding a plurality of aceptic cartons in a row, the combination of each carton being of a block shape having opposed pairs of side walls and a pair of end walls, and the walls of each of such pairs being transverse to one another, one end wall of each carton comprising an end closure having a main panel and an overlapping flap, said flap having a portion disposed transverse to the main panel, a paperboard blank formed with adjacent panels, hinged to one another across spaced respective fold lines, the panels including at least one major panel and inner and outer lap panels, said blank being adapted to be wrapped around the cartons, with the lap panels secured together and overflapping the one end wall of each carton, to define a sleeve having a pair of open ends, said cartons being in the sleeve with the row aligned with the open ends of the sleeve, the cartons at the opposite ends of the row being exposed out the open ends of the sleeve, the end closure flap portion being disposed transverse to the open ends of the sleeve and facing the adjacent open end of the sleeve, a tab formed off of the inner lap panel adjacent one of the exposed end cartons, the tab having an edge extended transverse to the fold lines in the blank, and being shaped and located to have said edge cooperate with the carton end closure flap portion, to hold the one carton within the sleeve.

2. A sleeve package for holding a plurality of aceptic cartons, according to the combination of claim 1, wherein the tab edge is adapted to face away from the adjacent open end of the sleeve.

3. A sleeve package for holding a plurality of aceptic cartons, according to the combination of claim 1, wherein a tab panel is hinged about a fold line to the inner lap panel, and wherein said tab and tab edge are formed on the tab panel.

4. A sleeve poackage for holding a plurality of aceptic cartons, according to the combination of claim 3, wherein the tab panel is adapted to be folded about its fold line, substantially 180 degrees, to lie against and between the inner lap panel and the carton and closure main panel.

5. A sleeve package for holding a plurality of aceptic cartons, according to the combination of claim 4, further including the carton end closure having said flap and adjacent main panel define a space therebetween that is open toward one of the side walls of the carton, said flap space being oriented to open in a direction transverse to the open ends of the sleeve, and wherein the tab is located and shaped to fit under the flap and into the space.

6. A sleeve package for holding a plurality of aceptic cartons, according to the combination of claim 4, further wherein the carton end closure flap and the tab are disposed generally coplanar, and wherein each is adapteed to lie between the adjacent end closure main panel and the inner lap panel.

7. A sleeve package for holding a plurality of aceptic cartons, according to the combination of claim 1, wherein said inner lap panel is hinged asbout a fold line to one major panel of the blank, and said tab is formed off of the inner lap panel and is disposed generally coplanar therewith.

8. A sleeve package for holding a plurality of aceptic cartons, according to the combination of claim 7, wherein further said inner lap panel and said tab being formed as a combined inner lap-tab panel having both a tap panel portion and a lap panel portion, the inner tab panel portion being generally coplanar with the inner lap panel portion and each being disposed between the outer lap panel and the carton end closure main panel, the outer lap panel being secured to the inner lap panel portion, and said tab edge being formed on the tab panel portion.

9. A sleeve package for holding a plurality of aceptic cartons, according to the combination of claim 8, further including the carton and end closure having said flap and adjacent main panel define a space therebetween that is open toward one of the side walls of the carton, said flap space being oriented to open in a direction transverse to the open ends of the sleeve, and wherein the tab panel portion is located and shaped to fit under the flap and into the space.

10. A sleeve package for holding a plurality of aceptic cartons in a row, the combination of each carton being of a block shape having opposed pairs of side walls and a pair of end walls, and the walls of each of such pairs being mutually perpendicular to one another, one end wall of each carton comprising an end closure having a main panel and an overlapping flat, said flap having a portion disposed transverse to the main panel, a paperboard blank having a perimeter edge, and having adjacent panels hinged to one another across spaced substantially parallel respective fold lines, the panels including at least one major panel and inner and outer lap panels, said blank being adapted to be wrapped around the cartons, with the lap panels secured together and overlapping the one end wall of each carton, to define a sleeve having a pair of open ends, said carton being in the sleeve with the row aligned with the open ends of the sleeve, the cartons at the opposite ends of the row being exposed out the open ends of the sleeve, the end closure flap portion being disposed transverse to the open ends of the sleeve and facing the adjacent open end of the sleeve, a tab formed off of the inner panel, and having an edge extended transverse to the fold lines in the blank, said tab edge being adapted to face away from the adjacent open end of the sleeve, said tab edge being defined as part of the perimeter edge of the blank, and said tab and tab edge being shaped and located to have said tab edge cooperate with the carton end closure flap portion, to hold the cartons within the sleeve.

11. A sleeve package for holding a plurality of aceptic cartons, according to the combination of claim 10, further wherein a tab panel is hinged about a fold line to the inner lap panel, said tab and tab edge being formed on the tab panel, and the tab panel being adapted to be folded about its fold line, substantially 180 degrees, to lie against and between the inner lap panel and the carton end closure main panel.

12. A sleeve package for holding a plurality of aceptic cartons, according to the combination of claim 11, further including the carton end closure having said flap and adjacent main panel define a space therebetween that is open toward one of the side walls of the carton, said flap space being oriented to open transverse to the open engs of the sleeve, and wherein the tab is located and shapoed to fit under the flap and into the space.

13. A sleeve package for holding a plurality of aceptic cartons, according to the combination of claim 11, further wherein the carton end closure flap and the tab are disposed generally coplanar, and wherein each is adapted to lie between the adjacent end closure main panel and the inner lap panel.

14. A sleeve package for holding a plurality of aceptic cartons, according to the combination of claim 13, further wherein said inner lap panel is hinged about a fold line to one major panel of the blank, said inner lap panel and said tab being formed as a combined inner lap-tab panel having both a tap panel portion and a lap panel portion, the inner tab panel portion being generally coplanar with the inner lap panel portion and each being disposed between the outer lap panel and the carton end closure main panel, the outer lap panel being secured to the inner lap panel portion, and said tab edge being formed on the tab panel portion.

15. A sleeve package for holding a plurality of aceptic cartons, according to the combination of claim 14, further including the carton end closure having said flap and adjacent main panel define a space therebetween that is open toward one of the side walls of the carton, said flap space being oriented to open transverse to the open ends of the sleeve, and wherein the tab panel portion is located and shaped to fit under the flap and into the space.

16. In combination, a plurality of aceptic cartons each carton being of a block shape having opposed pairs of side walls and a pair of end walls, and the walls of each of such pairs being mutually perpendicular to one another, one end wall of each carton comprising an end closure having a main panel and an overlapping flap that defines a space therebetween open toward one of the carton side walls, said flap having a portion upstanding from and extended transverse to the main panel, said cartons being arranged in a row with one carton side wall algined and with each flap spaced open in the same direction, a paperboard formed with major panels, and with inner and outer lap panels, said blank being wrapped around the cartons, with the lap panels overlying the one end wall of each carton and secured together, to define a sleeve open at the ends of the row, a tab formed off of the inner panel and having an edge extend in the direction transverse to the open ends of the sleeve, and said tab being adapted to underlie the flap, and said tab edge being adapted to abut the carton end closure flap portion, to hold the cartons in place within the sleeve.

* * * * *